US007938375B1

(12) United States Patent
Massegee

(10) Patent No.: US 7,938,375 B1
(45) Date of Patent: May 10, 2011

(54) PEN RETAINING SLEEVE

(76) Inventor: Casey Massegee, Edmond, OK (US)

( * ) Notice: Subject to any disclaimer, the term of this patent is extended or adjusted under 35 U.S.C. 154(b) by 202 days.

(21) Appl. No.: 12/315,671

(22) Filed: Dec. 6, 2008

Related U.S. Application Data

(60) Provisional application No. 61/008,816, filed on Dec. 21, 2007.

(51) Int. Cl.
*A47F 5/00* (2006.01)
*A47F 7/00* (2006.01)

(52) U.S. Cl. ..... 248/314; 248/229.13; 248/311.2; 248/312.1; 248/315; 248/316.1; 248/316.2; 248/309.1; 248/205.1; 211/69.6

(58) Field of Classification Search ..... 248/314, 248/229.13, 311.2, 312.1, 315, 316.1, 309.1, 248/316.2, 205.1; 211/69.6
See application file for complete search history.

(56) References Cited

U.S. PATENT DOCUMENTS

| | | | | |
|---|---|---|---|---|
| 416,003 | A | 11/1889 | Logan | |
| 1,674,259 | A * | 6/1928 | Palmer | 211/69.6 |
| 1,745,799 | A * | 2/1930 | Johnson et al. | 211/69.6 |
| 1,771,661 | A * | 7/1930 | Stilwell | 211/69.6 |
| 1,956,084 | A * | 4/1934 | Tefft | 211/69.6 |
| D201,479 | S | 6/1965 | Green | |
| 3,275,274 | A | 9/1966 | Hutcheon | |
| 3,306,566 | A * | 2/1967 | Paulson et al. | 248/346.04 |
| 3,655,062 | A * | 4/1972 | Curry | 211/69.6 |
| 4,334,622 | A * | 6/1982 | Mutschler | 211/69.5 |
| 4,501,358 | A * | 2/1985 | Zinbarg | 206/371 |
| 5,361,461 | A * | 11/1994 | Anscher | 24/115 G |
| 5,430,965 | A | 7/1995 | Lai | |
| 5,460,346 | A | 10/1995 | Hirsch | |
| 5,484,066 | A | 1/1996 | Luisi | |
| 5,490,708 | A | 2/1996 | Lee | |
| 5,823,363 | A * | 10/1998 | Cassel | 211/60.1 |
| 5,823,494 | A | 10/1998 | Jones | |
| 5,897,090 | A * | 4/1999 | Smith et al. | 248/311.2 |
| 6,007,131 | A | 12/1999 | Starik | |
| 6,435,749 | B1 * | 8/2002 | Lecce | 401/131 |
| 6,585,210 | B1 * | 7/2003 | Lee | 248/314 |
| D566,182 | S | 4/2008 | Snyder | |
| 7,380,655 | B1 * | 6/2008 | Thune et al. | 206/214 |
| 7,740,133 | B2 * | 6/2010 | Lamas | 206/214 |
| 2005/0074269 | A1 | 4/2005 | Asselin | |
| 2007/0029360 | A1 | 2/2007 | Connelly | |

* cited by examiner

*Primary Examiner* — Nkeisha J Smith
(74) *Attorney, Agent, or Firm* — Randal D. Homburg

(57) ABSTRACT

A collapsible pen holder installed within a surface of an object, including an automobile dashboard or briefcase, secures and retains a pen within a cylindrical sleeve slidably engaged within a cylindrical mounting frame member, exposing a pen cap of the pen. The pen is placed within the cylindrical sleeve which is then pushed into the mounting frame member until the cylindrical sleeve is retained within the mounting frame member by a locking mechanism, exposing only an end of the pen cap. To remove the pen from the pen holder, the end of the pen head is depressed, releasing the locking mechanism and ejecting the cylindrical sleeve from the mounting frame member, projecting the cylindrical sleeve from the surface by a spring mechanism allowing the pen to be removed from the cylindrical sleeve.

5 Claims, 2 Drawing Sheets

PEN RETAINING SLEEVE

CROSS REFERENCE TO RELATED APPLICATIONS

Applicant claims the benefit of Provisional Patent Application No. 61/008,816 filed on Dec. 21, 2007.

BACKGROUND OF THE INVENTION

1. Field of Invention

A collapsible pen holder installed within a surface of an object, including an automobile dashboard or briefcase, secures and retains a pen within a cylindrical sleeve slidably engaged within a cylindrical mounting frame member, exposing an end of the pen. The pen is placed within the cylindrical sleeve which is then pushed into the mounting frame member until the cylindrical sleeve is retained within the mounting frame member by a locking mechanism, exposing only an end of the pen. To remove the pen from the pen holder, the end of the pen is depressed, releasing the locking mechanism and ejecting the cylindrical sleeve from the mounting frame member, projecting the cylindrical sleeve from the surface by a spring mechanism allowing the pen to be removed from the cylindrical sleeve.

2. Description of Prior Art

The following United States patents were discovered and are disclosed within this application for utility patent. Most of the pen holders disclosed in the prior art simply have a means of retaining the pen using a clip, pocket or strap. Common embodiment include the pen holder attached to a sun visor, as indicated in U.S. patent Application No. 2007/0029360 to Connelly, a clip mechanism attached to a car console, as in U.S. Pat. No. 6,007,131 to Starik, multiple outer clip rings attached to any surface, as in U.S. Pat. No. 5,484,066 to Luisi, or within an adapted slot holding a writing instrument by its sides, as indicated in U.S. Pat. No. 5,430,965 to Lai. Cylindrical slots to hold a writing instrument are presented in several prior art patents, including an upright cylinder attached to a display board as in U.S. Pat. No. 3,275,274 to Hutcheon, the molded clip having a transverse cylinder apparently conforming to the shape of a writing instrument as in U.S. Pat. No. D201,479 to Green, or the pen holder rest shown in several configurations is U.S. Pat. No. 416,003 to Logan.

There was only one prior art patent that included a spring activated means along with an inner and outer member having a locking means. In U.S. Pat. No. 6,585,210 to Lee, discloses a secured pen holding mechanism provides a seat body formed with a slide socket, with the seat body and slide socket in a slidable relationship. There is a spring which forces and holds the slide socket with the seat body and also clamping members which hold a contoured top of the writing instrument on two opposing sides of the slide socket, which are pressed inward to grasp the pen when the slide socket is raised within the seat body. A latch hook retains the slide socket within the seat body when the device is in the locked position, the latch hook released to allow the spring below the slide socket to lift the slide socket from the seat body and release the writing instrument from the clamping members.

SUMMARY OF THE INVENTION

When traveling in a vehicle or working in an area, having a writing instrument available for use requires having to locate the writing instrument or trying to remember where it was left. When the writing instrument is expensive, it is also desired that it be kept in a safe and secure location where it is protected from loss or damage.

The present collapsible pen holder is provided to be included as original equipment or as an attractive addition to a vehicle or other work area. It contains and secures a writing instrument within the holder, especially those high quality pens, and stores the writing instrument below a surface when depressed into a locked position and extends the writing instrument for removal and use in an unlocked position, exposing only the head or the cap of the writing instrument when in the locked position, giving the writing instrument head or cap the appearance of a button.

DESCRIPTION OF THE DRAWINGS

The following drawings are informal drawings submitted with this provisional patent application.

DESCRIPTION OF THE PREFERRED EMBODIMENT

Figure 1:
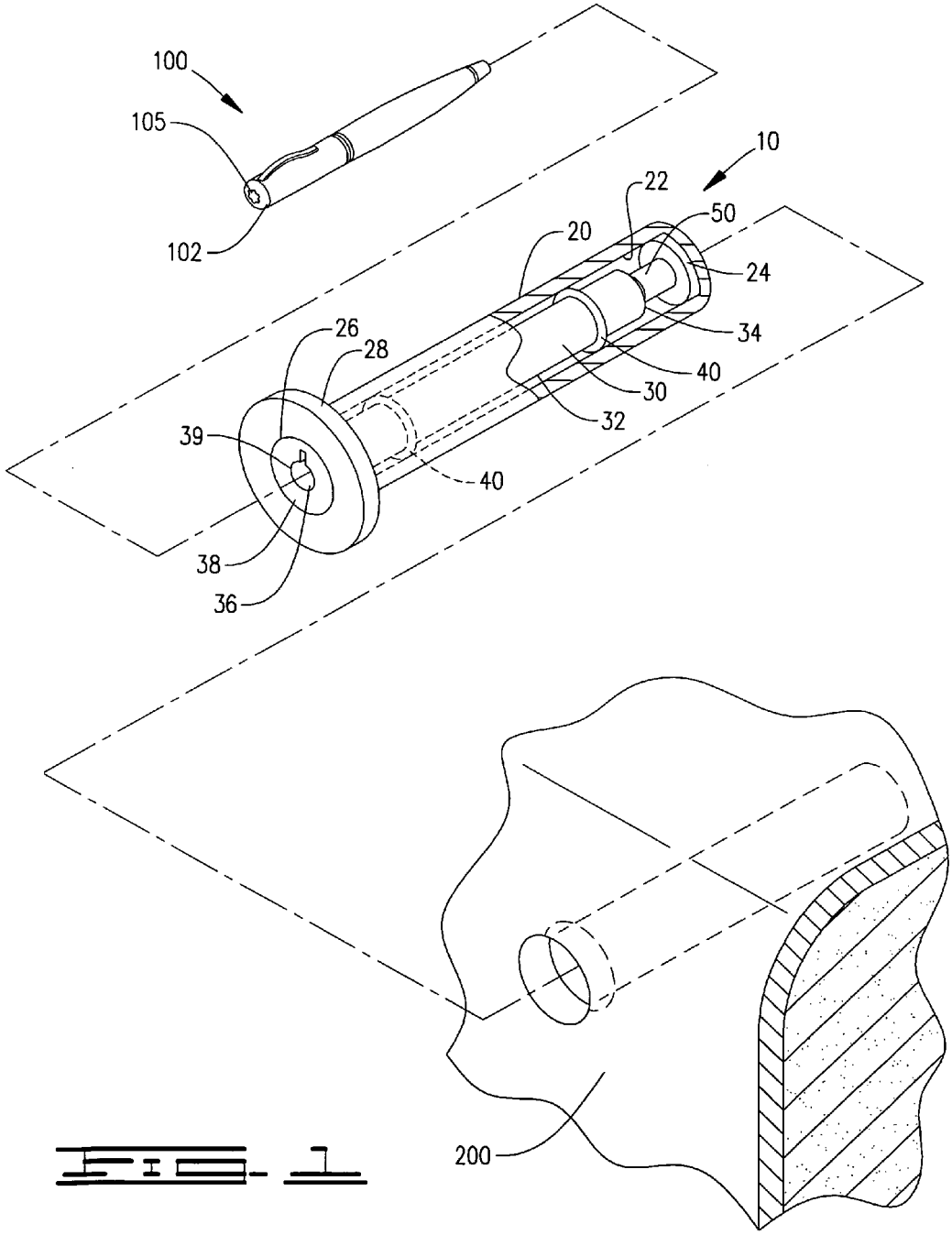
FIG. 1 is an exploded diagram of the collapsible pen holder in relationship to a flat surface within which the pen holder is installed.
Figure 2:
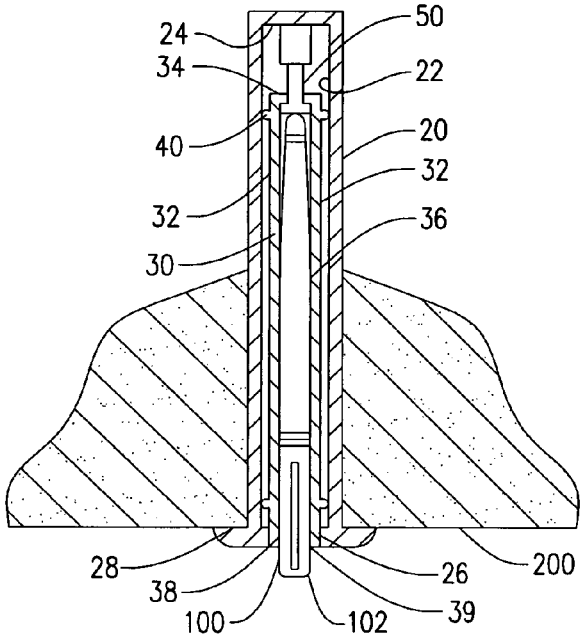
FIG. 2 is a side cross-sectional view of the collapsible pen holder in a locked position.
Figure 3:
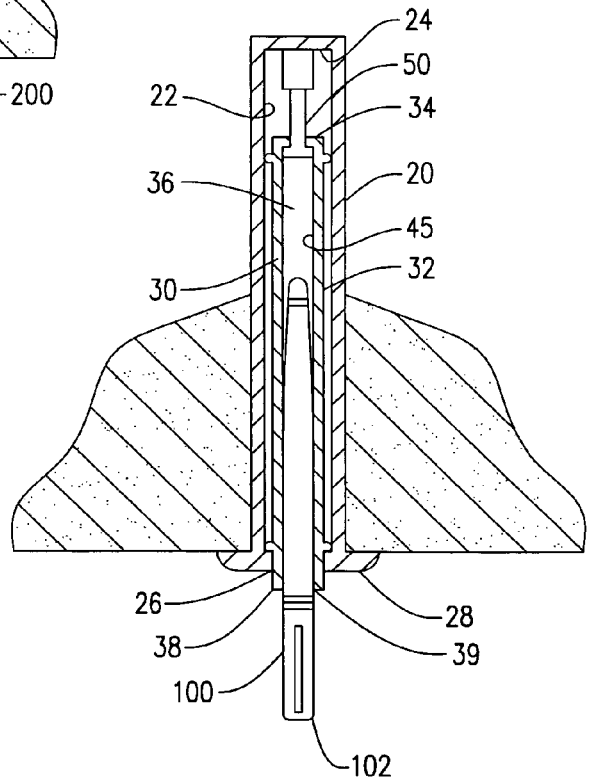
FIG. 3 is a side cross sectional view of the collapsible pen holder in an unlocked position.

A collapsible and retractable writing instrument holder 10 for installation into a surface 200, retains and secures a writing instrument 100, primarily an ink pen, as indicated in FIGS. 1-3 of the drawings. The holder 10 includes an outer cylindrical member 20 defining an inner surface 22, an inner floor 24 and an outer opening 26 providing an outer mounting flange 28 and an inner cylindrical member 30 defining an outer surface 32, an outer floor 34, an inner cavity 36 and an extendable end 38 having a contoured opening 39. The inner cavity 36 is provided to insert and secure the writing instrument 100 within the contoured opening 39. An activated locking means 50 is presented between the inner floor 24 of the outer cylindrical member 20 and the outer floor 34 of the inner cylindrical member 30, the activated locking means 50 holding a locked position wherein the inner cylindrical member 30 is retained within the outer cylindrical member 20, and urging the outer floor 34 of the inner cylindrical member 30 away from the inner floor 24 of the outer cylindrical member 20 in an unlocked position, extending the extendable end 38 from the outer opening 26 of the outer cylindrical member 20, allowing retrieval of the writing instrument 100 contained within the inner cavity 36. The inner cavity 36 of the inner cylindrical member receives and retains the writing instrument 100, exposing only an end 102 of the writing instrument or pen.

Preferably the outer mounting flange 28 of the outer cylindrical member 20 is affixed to the surface 200 around the opening in the surface 200 to maintain the outer mounting flange 28 upon the surface 200. The inner cylindrical member 30 may also be provided with the inner cavity 38 lined with a compressible material 45 or liner to retain the writing instrument 100 within the inner cavity 38 unless intentionally removed, with the end 102 of the writing instrument 100 giving the appearance of a decorative button, especially where the end of the writing instrument bears a logo 105. In FIGS. 1-3, the inner cylindrical member 30 also provides the outer surface 32 with a pair of slide enhancing projections 40 which provide a smooth slidable contact and means of reducing friction between the inner surface 22 of the outer cylindrical member 20 and the outer surface 32 of the inner cylindrical member 30. These slide enhancing projections 40 may be provided as polymeric rings surrounding the inner cylindrical member, ball bearings, of simply as incorporated rings or beads made part of the inner cylindrical member.

The activated locking means 50 may be provided as a spring coil and locking latch or may be provided as a piston shaft and cylinder as shown in the drawings, using air or fluid pressure to urge the piston shaft from the cylinder with a closed position and expanded position. It may also be accomplished by a rubber or elastic expansion device between the inner and outer floors.

An unlocked position is demonstrated in FIG. 3, while a locked position is shown in FIG. 2. In an unlocked position, the extendable end 38 of the inner cylindrical member 30 containing the writing instrument 100 would be extended and exposed for removal of the writing instrument from the inner cylindrical member. In the locked position, only the end 102, tip or head of the writing instrument would be exposed. Release of the inner cylindrical member 30 from a locked position, FIG. 2, for removal of the writing instrument would be accomplished by depressing the end 102 of the writing instrument 100, forcing the activated locking means 50 downward, the activated locking means 50 responding with an extended outward force, urging the outer floor 34 of the inner cylindrical member 30 away from the inner floor 24 of the outer cylindrical member 20 into the unlocked position of FIG. 3. To retract and lock the inner cylindrical member 30, the writing instrument 100 is inserted into the inner cavity 38 of the inner cylindrical member 30 and the end 102 is forcibly depressed, pushing the outer floor 34 of the inner cylindrical member 30 towards the inner floor 24 of the outer cylindrical member 20, compressing the activated locking means 50 into a locked position. The activated locking means 50 may perform the lock and unlock function in a manner similar to the double action positioning of a ball point pen mechanism, wherein the pen top is depressed exposing and locking the writing tip through the pen end for use, after which the pen top is again depressed, retracting the writing tip within the pen end until the next use.

The holder 10 does not have to be cylindrical, and the outer and inner cylindrical members 20, 30 may be presented with a square cross-section, not shown, or any shape, as long as the inner member 30 may be inserted within the outer member 20. The holder 10 may also be adapted to hold a stylus for a PDA or other electronic device accessory or writing instrument of choice. It is contemplated that the holder may be used for other items of value or choice not necessarily associated with writing instruments.

Although the embodiments of the invention have been described and shown above, it will be appreciated by those skilled in the art that numerous modifications may be made therein without departing from the scope of the invention as herein described.

What is claimed is:

1. A collapsible and retractable writing instrument holder installed into an opening within a surface of an object, retains and secures a writing instrument, said holder comprising:

an outer cylindrical member defining an inner surface, an inner floor and an outer opening providing an outer mounting flange;

an inner cylindrical member defining an outer surface, an outer floor, an inner cavity and an extendable end having a contoured opening provided to insert and secure said writing instrument within said contoured opening exposing only an end of said writing instrument; and an activated locking means between said inner floor of said outer cylindrical member and said outer floor of said inner cylindrical member, said activated locking means holding a locked position wherein said inner cylindrical member is fully retained within said outer cylindrical member, and an unlocked position wherein said outer floor of said inner cylindrical member is urged away from said inner floor of said outer cylindrical member, extending said extendable end from said outer opening of said outer cylindrical member, to access retrieval of said writing instrument contained within said inner cavity.

2. The instrument holder, as disclosed in claim 1, further comprising:

said outer mounting flange of the outer cylindrical member is affixed to the surface of said object around said opening in said surface of said object to maintain said outer mounting flange upon said surface of said object.

3. The instrument holder, as disclosed in claim 1, said inner cylindrical member further comprising:

said inner cavity lined with a compressible material or liner to retain said writing instrument within said inner cavity unless intentionally removed and exposing said end of said writing instrument; and said outer surface defining at least two slide enhancing projections providing smooth slidable contact and reducing friction between said inner surface of said outer cylindrical member and said outer surface of said inner cylindrical member.

4. A collapsible and retractable writing instrument holder installed into an opening within a surface of an object, retains and secures a writing instrument, said holder comprising:

an outer cylindrical member defining an inner surface, an inner floor and an outer opening providing an outer mounting flange;

an inner cylindrical member defining an outer surface, an outer floor, an inner cavity and an extendable end having a contoured opening provided to insert and secure said writing instrument within said contoured opening exposing only an end of said writing instrument, said inner cavity lined with a compressible material or liner to retain said writing instrument within said inner cavity unless intentionally removed and exposing said end of said writing instrument, and said outer surface defining at least two slide enhancing projections providing smooth slidable contact and reducing friction between said inner surface of said outer cylindrical member and said outer surface of said inner cylindrical member; and an activated locking means between said inner floor of said outer cylindrical member and said outer floor of said inner cylindrical member, said activated locking means holding a locked position wherein said inner cylindrical member is fully retained within said outer cylindrical member, and an unlocked position wherein said outer floor of said inner cylindrical member is urged away from said inner floor of said outer cylindrical member, extending said extendable end from said outer opening of said outer cylindrical member, to access retrieval of said writing instrument contained within said inner cavity.

5. The instrument holder, as disclosed in claim 4, further comprising:

said outer mounting flange of the outer cylindrical member is affixed to the surface of said object around said opening in said surface of said object to maintain said outer mounting flange upon said surface of said object.

* * * * *